United States Patent [19]

Gelman

[11] Patent Number: 4,875,179

[45] Date of Patent: Oct. 17, 1989

[54] READING ASSISTANCE DEVICE FOR WORD PROCESSOR

[76] Inventor: Gideon Gelman, 36/4 Arlozerov, Petah-Tiqwa, Israel, 49208

[21] Appl. No.: 80,441

[22] Filed: Jul. 31, 1987

[51] Int. Cl.[4] ..... B41J 11/38

[52] U.S. Cl. ..... 364/708; 40/341; 40/342; 40/343; 400/718

[58] Field of Search ..... 364/708; 400/711, 716, 400/718, 718.1, 718.2; 40/341, 342, 343

[56] References Cited

U.S. PATENT DOCUMENTS

| | | | |
|---|---|---|---|
| 4,269,403 | 5/1981 | Stephens et al. | 400/718 |
| 4,385,461 | 5/1983 | Wingfield | 400/716 |
| 4,554,753 | 11/1985 | Close | 40/341 |
| 4,558,527 | 12/1985 | Schroedel et al. | 40/343 |
| 4,580,915 | 4/1986 | Hellwig | 400/718 |
| 4,661,005 | 4/1987 | Lahr | 400/718 |

*Primary Examiner*—David H. Malzahn

*Attorney, Agent, or Firm*—Neuman, Williams, Anderson & Olson

[57] ABSTRACT

An improved reading assistance device is provided for use within the video display terminal of a word processing system. The reading device subtends the video display terminal, receives paper with written subject matter, and displays selected portions of the paper to a user. It includes a housing with an inlet for receiving the paper, a display screen and light source for displaying the paper, a drive for moving the paper through the housing, and an outlet through which the device discharges the paper.

9 Claims, 1 Drawing Sheet

READING ASSISTANCE DEVICE FOR WORD PROCESSOR

BACKGROUND OF THE INVENTION

1. Field of the Invention

The present invention relates to an improved reading assistance device for a word processing system, and more particularly to an improved reading assistance device which assists an operator of the system to quickly and easily read written matter which he or she enters into the word processing system.

2. Description of the Prior Art

The prior art includes a wide variety of devices which hold sheets or continuous webs of paper so that a typist or word processor operator may see the written matter on the paper and enter it into the word processing system. Some of these devices include components which automatically advance paper through a viewing area. Others include components which allow the operator to manually advance the paper.

One prior device includes an easel supported by an articulated arm and a clamp which secures the arm to the edge of a horizontal surface. This device is a complex mechanism susceptible to breakdown. First, it requires that an edge portion of a horizontal work surface panel lie proximate the work space of the operator. In addition, it requires time consuming initial adjustment to place the viewing area at the location desired by the word processor operator.

Another prior mechanism includes a large easel and stand which require a horizontal surface and a great deal of space. This device is also a complex mechanism susceptible to break down. It and the device described in the previous paragraph require that the user place them on either side of a visual display terminal of the word processing system. At these locations, the operator cannot quickly shift his or her vision from the paper to the screen. This deficiency reduces the efficiency of the operator and increases the cost of word processing services.

The improved reading assistance device of the present invention avoids the problems of the prior devices. It is a simple and inexpensive device. It allows the user to place it beneath the visual display terminal of a word processing system where it supports the visual display terminal. In this location, the device allows the operator to easily view the written matter on paper which it secures and which it advances at a speed at which the operator may vary. It minimizes the operator's eye and head movements, increases his or her efficiency, and thus reduces the cost of word processing services.

SUMMARY OF THE INVENTION

Accordingly, it is a general object of the present invention to provide an improved reading assistance device for a word processing system.

It is an object of this invention to provide a reading assistance device with a construction which minimizes the expense of manufacture and assembly and gives precise, uniform, and reliable performance.

It is another object of the present invention to provide an improved reading assistance device which does not require working space in addition to the working space required for a word processing system.

It is yet another object of this invention to provide an improved reading assistance device which facilitates easy reading and allows the word processor to easily shift his or her sight between written or printed copy to the visual display terminal of the word processing system.

Other objects, advantages and features of the present invention will become apparent upon reading the following detailed description and appended claims and upon reference to the accompanying drawings.

The improved reading assistance device of the present invention achieves the foregoing objects. It includes a generally rectangular housing of sufficient strength and rigidity to support the visual display terminal (VDT) of a word processing system. Thus, the user may place the device between the VDT and a horizontal support surface or between the VDT and the system's central processing unit (CPU). At this location, a user of the device can easily shift his or her sight between the display of the device and the VDT.

The housing has a front wall which includes a viewing screen and which lies at a shallow, acute angle from the vertical to facilitate viewing through the screen. In the preferred embodiment, this screen is a magnifying lens which magnifies the printed matter which the operator views through it. Alternatively, this screen may comprise a flat plate of glass or an opening in the front wall. To further facilitate viewing and increase resolution, the device includes a light source secured to the housing, behind the screen and the portion of the paper appearing on the screen.

The housing also includes a first opening through which the device receives the paper and a second opening through which the operator may remove the paper. The first opening or inlet may lie at the front bottom portion of the housing and the second opening or outlet at the side top portion of the housing. Alternatively, the housing may include an inlet at the bottom side portion of the housing and an outlet at the top side portion of the housing. Moreover, it may include an inlet and outlet at any convenient location where the operator may easily insert the paper into the housing and remove it.

Wall strips formed of metal, plastic or any other suitable material, disposed inside the housing, and fixably secured to the walls of the housing define a path for the paper along with the walls of the housing. This path extends from the inlet, past the viewing screen and through the outlet.

To advance the paper, the reading assistance device of the preset invention includes a paper advancing drive disposed in the housing. This drive has at least one advancing roller rotatably mounted with suitable connections to the housing. Preferably, the roller includes end portions with gear-like projections which engage the paper through corresponding openings at the edges of the paper. However, the drive roller may have a smooth, soft surface, e.g., soft rubber, through which the roller makes friction contact with the paper against a guide roll to advance the paper.

The drive includes an electric motor which provides the force for rotating the advancing roller. Suitable connections fixedly mount the motor to the housing, within the housing. To transmit the force of the motor to the advancing roller, the device includes a belt and pulley assembly. The belt in this assembly is a flat belt, but a timing belt may serve the same function. Moreover, a conventional gear drive assembly is a suitable alternative for the belt and pulley assembly. The drive also includes a conventional control assembly which allows the operator to vary the speed of the drive and to operate the drive continuously or intermittently.

To install the device, the operator places it between the visual display terminal and the central processing unit of a word processing system. At this location, the improved reading assistance device of the present invention allows the operator to read the material which he or she has to enter into the word processing system and to quickly shift his or her sight from the visual display terminal to the paper.

To operate this device, the operator places a sheet or a continuous web of paper in the inlet of the device and feeds it through the device along the defined path until the drive roller engages the paper. Then, the operator sets the drive to a desired speed, advancing the paper through the device while he or she observes the printed matter through the viewing screen.

BRIEF DESCRIPTION OF THE DRAWINGS

For a more complete understanding of the present invention, one should now refer to the embodiments illustrated in greater detail in the accompanying drawings and described below by way of examples of the invention. In the drawings.

While the text below describes the invention in connection with a preferred embodiment and one alternative embodiment, one should understand that the invention is not limited to these embodiments. Furthermore, one should understand that the drawings are not necessarily to scale. In certain instances, the applicant may have omitted details which are not necessary for an understanding of the present invention.

DETAILED DESCRIPTION OF THE DRAWINGS AND THE PREFERRED EMBODIMENTS

Figure 1A:
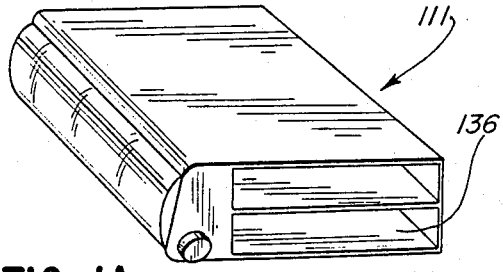
FIG. 1A is a perspective view of a second embodiment of the present invention.
Figure 1:
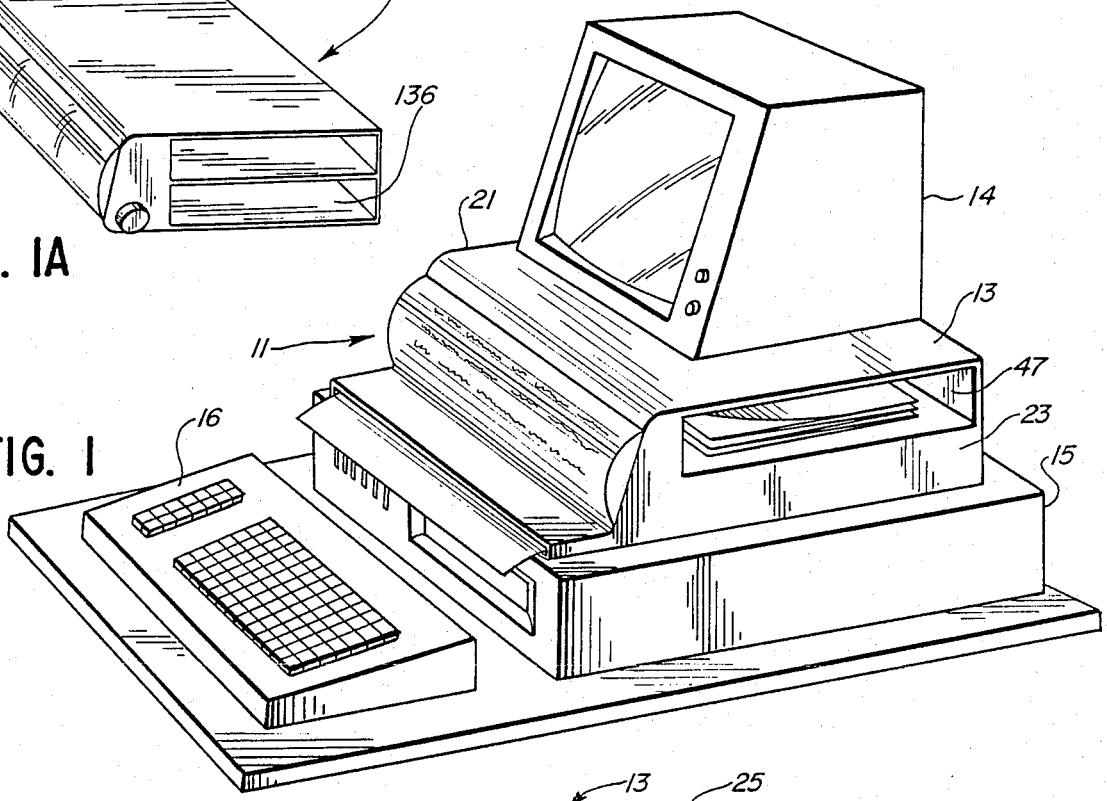
FIG. 1 is a perspective view of a first embodiment of the improved reading assistance device of the present invention disposed between a visual display terminal and a central processing unit of a word processing system.
Figure 2:
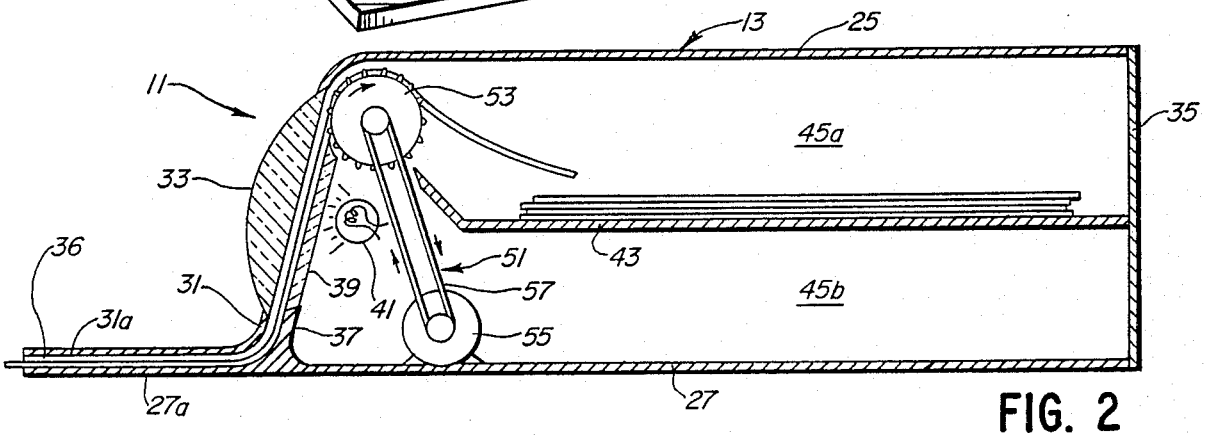
FIG. 2 is a sectional view of the device shown in FIG. 1.

Turning now to the drawings, FIG. 1 shows the preferred embodiment of the reading assistance device according to the invention generally at 11 in place in a word processing system. The system includes a VDT 14, a CPU 15, and a keyboard 16. The device 11 includes a generally rectangular housing 13 formed out of metal, stiff plastic, or any other suitable material. This housing has sufficient strength and rigidity to support the VDT of a word processing system. Thus, the reading assistance device 11 can also serve as a support between the VDT and the CPU of the word processing system where the operator can easily view the written matter presented by the device and quickly shift his or her sight between the VDT and the device 11.

The housing 13 has opposite side walls 21 and 23, a top 25, a bottom 27, a front wall 31 including a viewing screen 33, and a back wall 35. A segment 31*a* of the front wall and a segment 27*a* of the housing bottom project outward of the housing 13 and define an inlet 36 for the paper which the device receives. The front wall 31 of the housing 13 lies at a shallow, acute angle from the vertical so that the operator may easily view the printed or written subject matter through its viewing screen 33.

The viewing screen 33 comprises a magnifying lens which further facilitates reading of the printed or written subject matter. Alternatively, the viewing screen may comprise a flat plate of glass which does not distort the image seen through it. Furthermore, the front wall 31 may merely have an opening as a viewing area for the device 11.

A wall strip 37 formed of metal, plastic or any other suitable material, disposed within the housing 13, and fixedly secured to the housing 13 with suitable connections helps to define a portion of the path over which the paper moves through the device. This path extends from the inlet 36 between the housing segments 31*a* and 27*a*, upward and parallel to the viewing screen 33 between the screen and the strip 37.

The strip 37 includes a transparent or translucent segment 39 disposed behind the screen 33 and the portion of the paper viewed through the screen. This feature allows a light source 41 to illuminate the paper which the operator views through the viewing screen 33. This light source 41 may be any suitable light fixture fixedly secured to the housing 13 or any internal wall strip of the device 11. As an alternative to the transparent segment 39, the strip 37 may include an opening at the location of segment 39.

A second wall strip 43 secured to the housing 13 and formed of materials similar to those used to form the strip 37 generally divides the inside of the housing into two chambers, 45*a* and 45*b*. It also serves as a tray on top of which the paper moves so that the operator may remove it from the device. An opening or outlet 47 in sidewall 23 allows the operator to remove the paper out of chamber 45*a*.

To advance the paper along its path, the device 11 includes a drive 51 disposed in the housing 13. This drive includes an advancing roller 53 rotatably mounted to the sidewalls of the housing proximate the path of travel of the paper. It includes end portions with gear-like projections which engage the paper through corresponding openings at the edges of the paper. Alternatively, the roller 53 may have a soft, smooth surface, e.g., a soft rubber surface, which can make friction contact with the paper by pressing it against a guide roll and advancing it.

The drive 51 also includes a motor 55 fixedly mounted to the housing 13 with suitable connections. This motor provides the force to rotate the roller 53. A belt and pulley assembly 57 transmits the force from the motor 55 to the roller 53. The belt may be a flat belt or a timing belt. Moreover, a conventional gear drive assembly is a suitable alternative for the belt and pulley assembly 57. The drive further includes a conventional control assembly (not shown) which allows the operator to vary the speed of the drive and to operate the drive continuously or intermittently.

To operate this device, the operator places a sheet or a continuous web of paper in the inlet of the device and feeds it through the device along the defined path until the drive roller engages the paper. Then, the operator sets the drive of the device to a desired speed, advancing the paper through the device while he or she observes the printed matter through the viewing screen.

Figure 3:
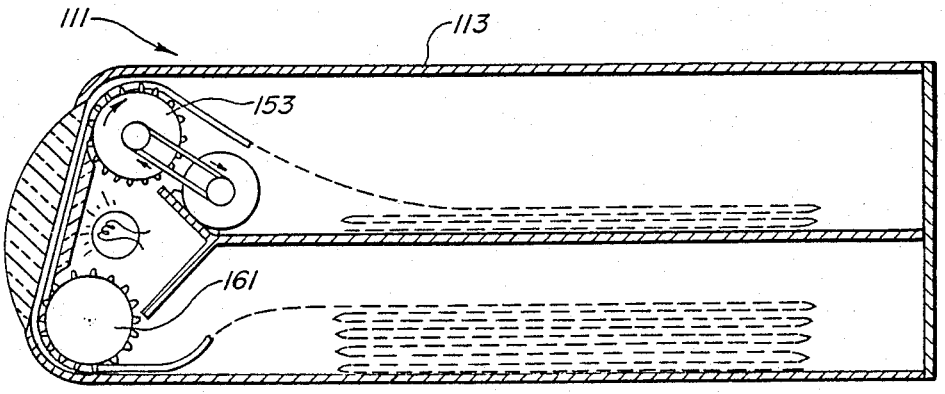
FIG. 3 is a sectional view of the device shown in FIG. 1A.

FIGS. 1A and 3 show an alternative embodiment of the improved reading assistance device of the present invention generally at 111. In this embodiment, the inlet 136 through which the device receives the paper lies at the side of the unit and comprises an opening in the lower portion of the side wall. The device 111 also includes a guide roller 161 with which the operator manually advances (using a button secured to the roll and disposed outside of the housing 113) the paper to the advancing roller 153. Suitable connections rotatably mount the guide roller 161 to the housing 113 so that the roller 161 may rotate freely.

Thus, the applicant has provided an improved reading assistance device for a word processing system. The reading assistance device is simple to operate and simple to construct. It includes a housing with a viewing screen, an inlet for receiving the paper, guide strips for defining a path along which the paper moves through the device, a light source for illuminating the portion of the paper viewed through the screen and an outlet through which the operator removes the paper from the device. It also includes a motor drive for advancing the paper. The device lies on top of the central processing unit of a word processing system and supports the visual display terminal of the system. At this location, the operator may easily view the printed matter through the viewing screen at the front of the device and shift his or her sight between the video display terminal and the device.

While the applicant has shown two embodiments, one will understand, of course, that the invention is not limited to these embodiments since those skilled in the art to which the invention pertains may make modifications and other embodiments of the principles of the invention, particularly upon considering the foregoing teachings. The applicant, therefore, by the appended claims, intends to cover any modification and other embodiments that incorporate those features which constitute the essential features of this invention.

What is claimed is:

1. A reading assistance device for use with a word processing system including a video display terminal and for displaying written material from a length of paper, said device comprising:

a housing including a bottom for engaging a subtending horizontal support surface, a top for supporting said video display terminal, a central divider defining a retrieval compartment within said housing, a front having a transparent section for viewing said paper, an inlet for receiving said paper and means to access said compartment for removal of said paper;

guide means disposed in said housing for guiding said paper along a direct path from said inlet past said transparent section to said retrieval compartment without emerging from said housing so that the user can view selected portions of said paper; and drive means disposed in said housing for engaging said paper and moving said paper along said guide means.

2. The reading assistance device of claim 1 further comprising a light source disposed in said housing for illuminating the paper moving past said transparent section.

3. The reading assistance device of claim 1, wherein said housing has a generally rectangular shape.

4. The reading assistance device of claim 1, wherein said guide means includes guide rollers and structural strip members.

5. The reading assistance device of claim 1, wherein said drive means includes a drive roller for engaging said paper, a motor for rotating said drive roller and transmitting means for transmitting the force of said motor to said drive roller.

6. In combination with a video display terminal of a word processing system, a reading assistance device subtending said video display terminal for supporting said video display terminal and for displaying written matter from a length of paper comprising:

a housing including a bottom for engaging a subtending horizontal support surface, a top for supporting said video display terminal, a central divider defining a retrieval compartment within said housing, a front having a transparent section for viewing said paper, an inlet for receiving said paper and means to access said compartment for removal of said paper;

a guide means disposed in said housing for guiding said paper along a direct path from said inlet past said transparent section to said retrieval compartment without emerging from said housing so that the user can view selected portions of said papers; and drive means disposed in said housing for engaging said paper and moving said paper along said guide means.

7. The improvement of claim 6 further comprising a light source disposed in said housing for illuminating the paper moving past said transparent section.

8. A front loading reading assistance device for use with a word processing system including a video display terminal and for displaying written material from a sheet of paper, said device comprising:

a housing including a bottom for engaging a subtending horizontal support surface, a top for supporting said video display terminal, a retrieval compartment within said housing, a front having a transparent section for viewing said paper and a load inlet for receiving said paper, and a means to access said compartment for removal of said paper;

guide means disposed in said housing for guiding said paper along a direct path from said front load inlet past said transparent section to said retrieval compartment without emerging from said housing so that the user can view selected portions of said paper; and drive means disposed in said housing for engaging said papers and moving said papers through said guide means.

9. The front loading reading assistance device of claim 8 further comprising a light source disposed in said housing for illuminating the paper moving past said transparent section.

* * * * *